US007728703B2

(12) United States Patent
Kim et al.

(10) Patent No.: US 7,728,703 B2
(45) Date of Patent: Jun. 1, 2010

(54) RF MEMS SWITCH AND METHOD FOR FABRICATING THE SAME

(75) Inventors: Jong-seok Kim, Hwaseong-gun (KR); Sang-wook Kwon, Seongnam-si (KR); Dong-kyun Kim, Suwon-si (KR); Che-heung Kim, Yongin-si (KR); Sang-hun Lee, Seoul (KR); Young-tack Houng, Suwon-si (KR); Chang-seung Lee, Yongin-si (KR); In-sang Song, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 327 days.

(21) Appl. No.: 11/396,573

(22) Filed: Apr. 4, 2006

(65) Prior Publication Data

US 2007/0115081 A1 May 24, 2007

(30) Foreign Application Priority Data

Nov. 21, 2005 (KR) ..... 10-2005-0111380

(51) Int. Cl.

| | |
|---|---|
| ***H01P 1/10*** | (2006.01) |
| ***H01H 11/04*** | (2006.01) |
| ***H01H 9/00*** | (2006.01) |
| ***H01H 57/00*** | (2006.01) |

(52) U.S. Cl. ..... 333/262; 333/105; 29/592.1; 29/600; 29/832; 29/840; 29/846

(58) Field of Classification Search ..... 333/105, 333/262, 187; 29/592.1, 600, 832, 840, 846
See application file for complete search history.

(56) References Cited

U.S. PATENT DOCUMENTS 4,595,855 A 6/1986 Farrall
6,016,092 A * 1/2000 Qiu et al. ..... 333/262

(Continued)

FOREIGN PATENT DOCUMENTS

DE 4205029 C1 2/1993

(Continued)

OTHER PUBLICATIONS

Petersen K E: "Dynamic MicroMechanics on Silicon: Techniques and Devices", IEEE Transactions on Electron Devices, IEEE Service Center, Piscataway, NJ, vol. 25, No. 10, Oct. 1978, pp. 1241-1249, ISSN: 0018-9383.

(Continued)

*Primary Examiner*—Benny Lee
*Assistant Examiner*—Alan Wong
(74) *Attorney, Agent, or Firm*—Sughrue Mion, PLLC

(57) ABSTRACT

An RF MEMS switch and a method for fabricating the same are disclosed, in which the RF MEMS device is down driven at a low voltage using a piezoelectric effect. The RF MEMS switch includes a substrate provided with RF signal lines and a cavity, a cantilever positioned on the cavity, having one end fixed to the substrate, and a contact pad connecting the RF signal lines with the cantilever in contact with the RF signal lines when the cantilever is down driven.

22 Claims, 10 Drawing Sheets

A-A

U.S. PATENT DOCUMENTS

| | | | | |
|---|---|---|---|---|
| 6,100,477 | A | 8/2000 | Randall et al. | |
| 6,433,657 | B1 * | 8/2002 | Chen | 333/262 |
| 6,875,936 | B1 * | 4/2005 | Suzuki et al. | 200/181 |
| 7,109,641 | B2 | 9/2006 | Park | |
| 7,151,425 | B2 * | 12/2006 | Park et al. | 333/262 |
| 7,230,513 | B2 * | 6/2007 | Chou | 333/262 |
| 7,459,827 | B2 | 12/2008 | Kawakubo et al. | |
| 2005/0237127 | A1 * | 10/2005 | Van Delden | 333/105 |

FOREIGN PATENT DOCUMENTS

| | | | |
|---|---|---|---|
| DE | 10031569 | A1 | 2/2001 |
| DE | 10152945 | A1 | 5/2003 |
| JP | 57-115735 | A | 7/1982 |
| JP | 57-115736 | A | 7/1982 |
| JP | 10-209517 | A | 8/1998 |
| JP | 2001076605 | A | 3/2001 |
| JP | 2004-327441 | A | 11/2004 |
| JP | 2005-313276 | A | 11/2005 |
| WO | 9419819 | A1 | 9/1994 |

OTHER PUBLICATIONS

Petersen K E: "Micromechanical Membrane Switches on Silicon", IBM Journal of Research and Development, International Business Machines Corporation, New York, NY, US, vol. 23, No. 4, Jul. 1, 1979, pp. 376-385, ISSN: 0018-8646.

* cited by examiner

RF MEMS SWITCH AND METHOD FOR FABRICATING THE SAME

CROSS-REFERENCE TO RELATED APPLICATIONS

This application claims priority from Korean Patent Application No. 2005-111380, filed on Nov. 21, 2005, in the Korean Intellectual Property Office, the entire content of which is incorporated herein by reference.

BACKGROUND OF THE INVENTION

1. Field of the Invention

The present invention relates to a radio frequency Microelectromechanical System (RF MEMS) switch. More particularly, the present invention relates to an RF MEMS switch and a method for fabricating the same, in which the RF MEMS device is down bent at a low voltage.

2. Description of the Related Art

Generally, an RF MEMS switch is used in various fields. For example, an RF MEMS device is used as a band selector, a multi-function switch, or a phase shifter in mobile products.

Various kinds of RF MEMS switches have been developed. Examples of an RF MEMS switch include an electrostatic RF MEMS switch based on electrostatic phenomenon and a piezoelectric RF MEMS switch based on piezoelectric effect. FIGS. 1 and 2 respectively show these RF MEMS switches.

FIG. 1 is a front sectional view illustrating an electrostatic RF MEMS switch. Referring to FIG. 1, the electrostatic RF MEMS switch 10 includes a substrate 1 provided with an RF signal line 12*a*, an anchor 13, and a driving line 14, a cantilever 11 fixed to the anchor 13 at an interval of 1 μm from the RF signal line 12*a*, and a contact pad 12 formed at an end of the cantilever 11 to be switched on/off in contact with the RF signal line 12*a* in accordance with driving of the cantilever 11. If an external voltage is applied to the RF MEMS switch 10 through the driving line 14, electrostatic force occurs between the driving line 14 and the cantilever 11, so that the cantilever 11 is down driven to allow the contact pad 12 to transmit an RF signal in contact with the RF signal line 12*a*. However, the electrostatic RF MEMS switch 10 has a high driving voltage of 3V or greater and a high volume. Because of this, the general trend is to substitute the electrostatic RF MEMS device with a piezoelectric RF MEMS switch shown in FIG. 2.

FIG. 2 is a plan view illustrating a piezoelectric RF MEMS switch. Referring to FIG. 2, an RF MEMS switch 20 of lead zirconate titanate (PZT, $Pb(Zr,Ti)O_3$), which is up driven, is shown. The piezoelectric RF MEMS switch 20 includes a substrate 1 plated with an RF input signal line 22*a* and an RF output signal line 22*b*, and a plurality of cantilevers 21*a* to 21*d* that support a contact pad 22 positioned below the RF signal lines 22*a* and 22*b* and spaced apart from the RF signal lines 22*a* and 22*b*. The cantilevers 21*a* to 21*d* comprise an upper electrode layer, a piezoelectric layer, a lower electrode layer, and a membrane. If a DC voltage is applied to the electrode layers of the cantilevers 21*a* to 21*d* through driving lines 24*a* and 24*b*, the cantilevers 21*a* to 21*d* are up bent in a cavity 23*a*. Then, the contact pad 22 formed at an end of the cantilevers 21*a* to 21*d* contacts the RF signal lines 22*a* and 22*b* so that the RF signal lines 22*a* and 22*b* are connected with each other to transmit an RF signal. The piezoelectric RF MEMS switch 20 can be driven at a voltage less than 3V, generates displacement of about 1.8 μm when the cantilever has a length of 100 μm, and has little power consumption.

However, there occurs some difficulty in fabricating the aforementioned piezoelectric RF MEMS switch 20. Particularly, the fabricating process of the piezoelectric RF MEMS switch 20 is not simple. In the piezoelectric RF MEMS switch 20, the piezoelectric layer or the membrane of the cantilevers is fabricated at a high temperature. For this reason, the piezoelectric layer or the membrane should be formed prior to a coplanar waveguide (CPW) line including the RF signal lines. If the CPW line is formed on the substrate and a piezoelectric thin film material is fabricated on the CPW line, diffusion of metal occurs at a high temperature or silicide is formed. Therefore, in the piezoelectric RF MEMS switch, as shown in FIG. 2, the cantilevers 21*a* to 21*d* are up bent and a separate wafer or substrate 1 is prepared on the cantilevers 21*a* to 21*d* so as to form the CPW line. In this case, a rear surface (bottom) of the substrate is excessively etched. In the piezoelectric RF MEMS switch 20 shown in FIG. 2, after the RF signal lines 22*a* and 22*b* are formed on the upper surface of the substrate 1 through plating, an opposite surface of the substrate 1 is fully etched so as to form the cantilevers 21*a* to 21*d*.

To solve the difficulty in fabricating the RF MEMS switch, Korean Laid-Open Patent Nos. 2005-86629 and 2005-0076149 disclose a piezoelectric RF MEMS switch in which cantilevers are formed on a cavity so that they can be down driven. However, this piezoelectric RF MEMS switch separately requires a substrate provided with cantilevers and a substrate provided with an RF signal line. In this respect, if a CPW line and cantilevers are provided on one substrate in the piezoelectric RF MEMS switch, it is possible to provide a simple fabricating process of the piezoelectric RF MEMS switch. In such case, it is easy to form the CPW line, and switching operation of the RF MEMS switch would exactly be performed.

SUMMARY OF THE INVENTION

Accordingly, the present invention is directed to an RF MEMS switch and a method for fabricating the same, which addresses the problems and disadvantages of the related art.

An object of the present invention is to provide an RF MEMS switch that is driven at a low voltage without power consumption.

Another object of the present invention is to provide a method for fabricating an RF MEMS device driven at a low voltage without power consumption.

To achieve these aspects and in accordance with the purpose of the invention, an RF MEMS switch includes a substrate provided with RF signal lines and a cavity, a cantilever positioned on the cavity, having one end fixed to the substrate, and a contact pad connecting the RF signal lines with the cantilever in contact with the RF signal lines when the cantilever is down driven.

The substrate is provided with a CPW line.

The RF signal lines are comprised of an RF input signal line and an RF output signal line. In an exemplary embodiment, the RF signal lines are formed to be lower than the contact pad.

The cavity is positioned between the RF input signal line and the RF output signal line. However, in an RF MEMS switch according to another exemplary embodiment of the present invention, the RF signal lines may be provided in front of the cavity.

The cantilever is comprised of one beam or a pair of beams. In an exemplary embodiment, the cantilever is provided with a lower electrode, a piezoelectric layer, an upper electrode and a membrane in due order from a down direction. The upper electrode and the lower electrode are respectively connected with their driving lines. The membrane is formed to open the lower electrode.

The contact pad is formed on an upper end of the cantilever. In the RF MEMS switch according to another exemplary embodiment of the present invention, the contact pad may be projected along a longitudinal direction of the cantilever.

In an exemplary embodiment, the RF MEMS switch further includes a passivation layer formed on a surface of the substrate.

In another aspect of the present invention, a method for fabricating an RF MEMS switch includes forming a cavity in a substrate, fabricating a cantilever on the cavity, forming RF signal lines in the substrate provided with the cavity, and forming a contact pad in the cantilever.

The step of forming the cavity includes an etching process.

In an exemplary embodiment, the step of fabricating the cantilever includes forming a passivation layer on the substrate, forming a first sacrificing layer in the cavity, and sequentially forming a lower electrode layer, a piezoelectric layer, an upper electrode layer, and a membrane layer on the first sacrificing layer and patterning them.

The passivation layer is formed of silicon oxide or silicon nitride.

The first sacrificing layer is formed of any one of polysilicon, low temperature oxide (LTO), Tetraethylorthosilicate (TEOS), polymer for photoresist, metal, and alloy.

The upper electrode and the lower electrode are formed of any one of platinum (Pt), rhodium (Rh), tantalum (Ta), gold (Au), molybdenum (Mo) and AuPt.

The piezoelectric layer is formed of a piezoelectric material such as PZT, barium titanate, indium oxide (ITO), zinc oxide, and aluminum nitride (AIN).

The membrane layer is formed of any one of silicon nitride, AIN, polysilicon oxide, TEOS, Mo, Ta, Pt, and Rh.

The RF signal lines are formed of a conductive metal such as Au, Rh, titanium (Ti), Ta, Pt, and gold/nickel alloy (AuNix). In an exemplary embodiment, the RF signal lines are formed of Au.

In an exemplary embodiment, the step of forming the contact pad includes depositing a second sacrificing layer on the substrate provided with the RF signal lines and patterning the second sacrificing layer, forming the contact pad in the cantilever on the patterned sacrificing layer, and removing the first and second sacrificing layers.

In the method for fabricating an RF MEMS switch according to the present invention, a gap between the RF signal line and the contact pad is controlled by the thickness of the second sacrificing layer.

The second sacrificing layer is formed of any one of polysilicon, LTO, TEOS, polymer for photoresist, metal, and alloy.

BRIEF DESCRIPTION OF THE DRAWINGS

The above aspects and features of the present invention will be more apparent by describing certain exemplary embodiments of the present invention with reference to the accompanying drawings, in which.

DETAILED DESCRIPTION OF THE EXEMPLARY EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

Figure 1:
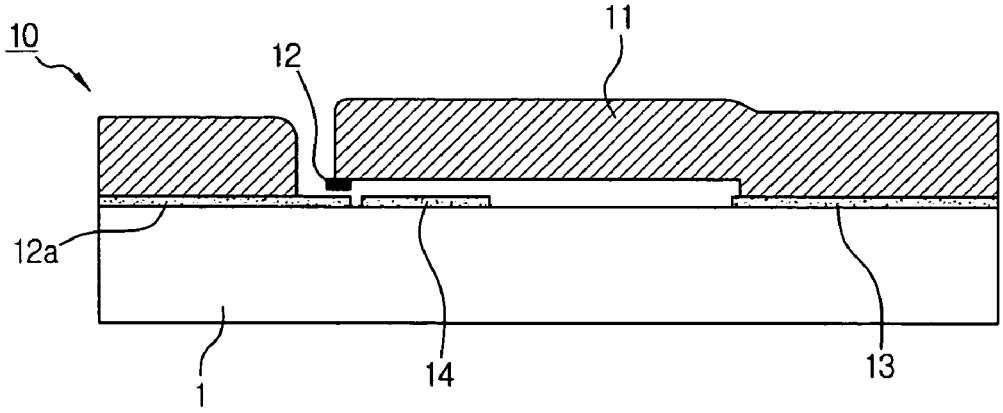
FIG. 1 (PRIOR ART)
FIG. 1 is a front sectional view illustrating an electrostatic RF MEMS switch.
Figure 2:
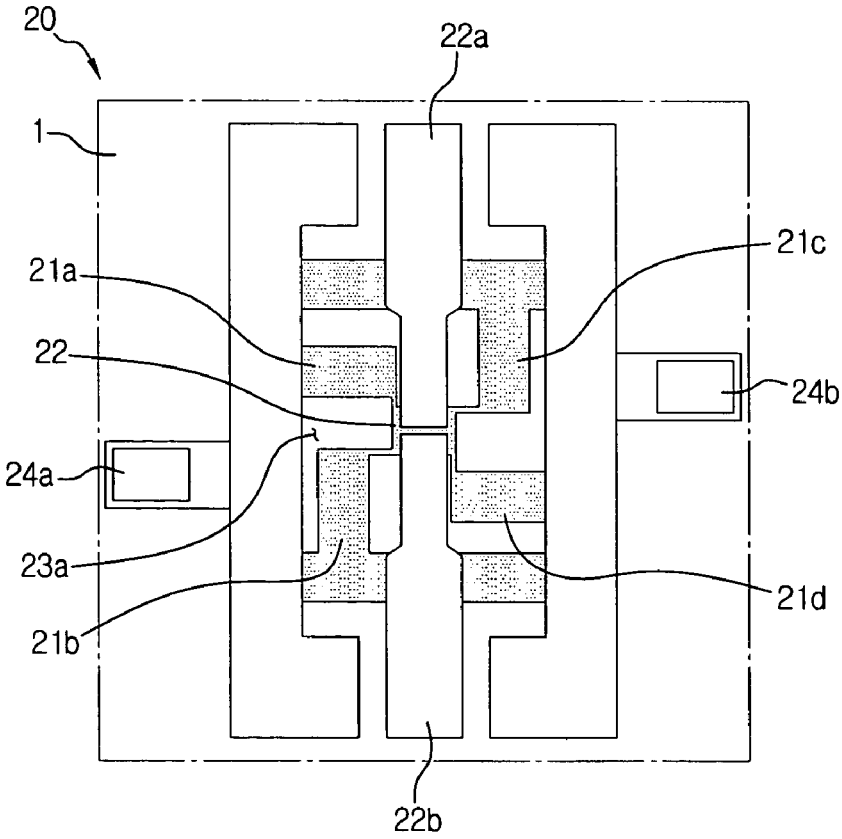
FIG. 2 (PRIOR ART)
FIG. 2 is a plan view illustrating an up driven RF MEMS switch based on PZT.
Figure 3:
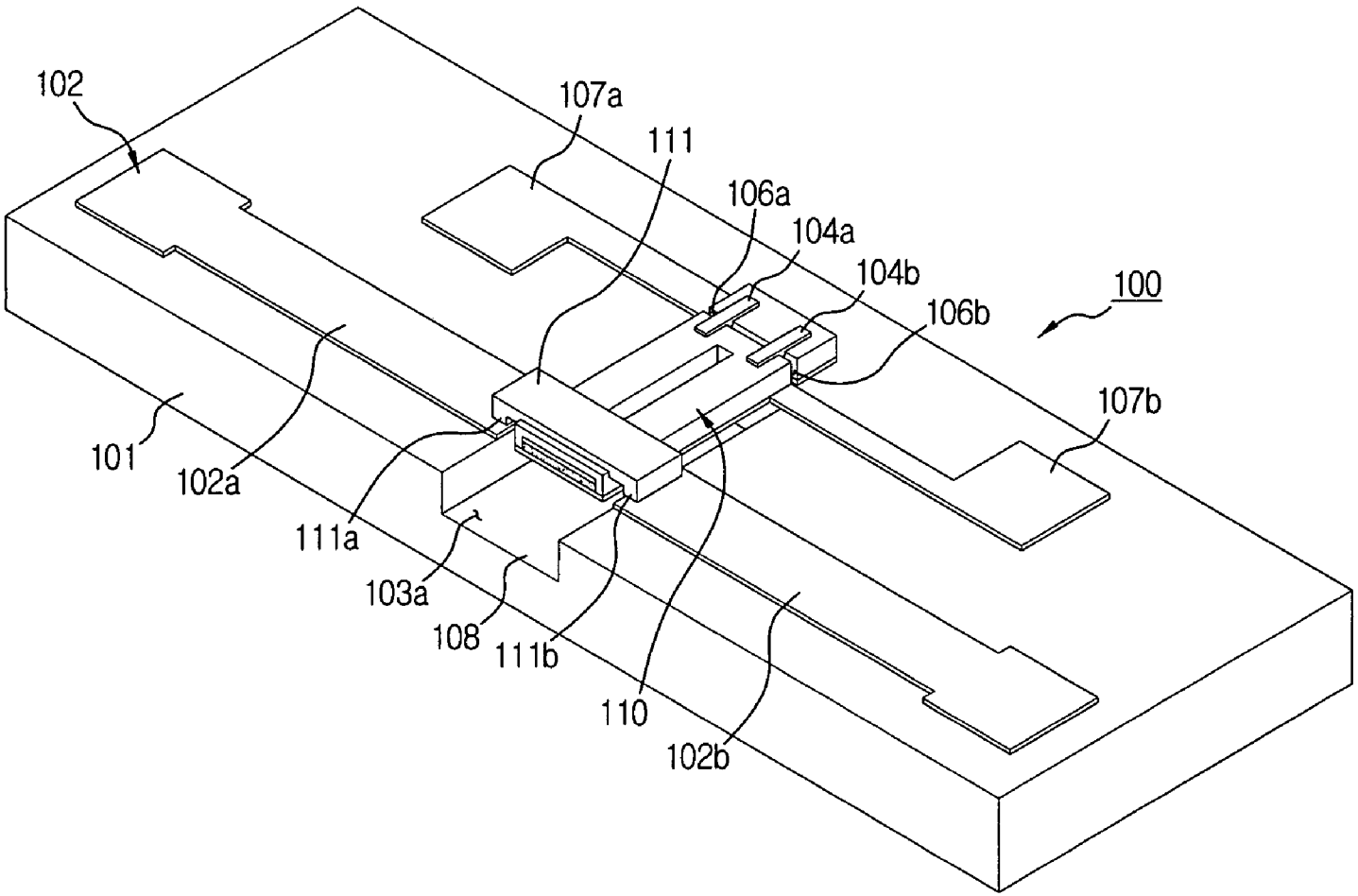
FIG. 3 is a perspective view illustrating a down driven RF MEMS switch according to the first exemplary embodiment of the present invention.
Figure 4A:
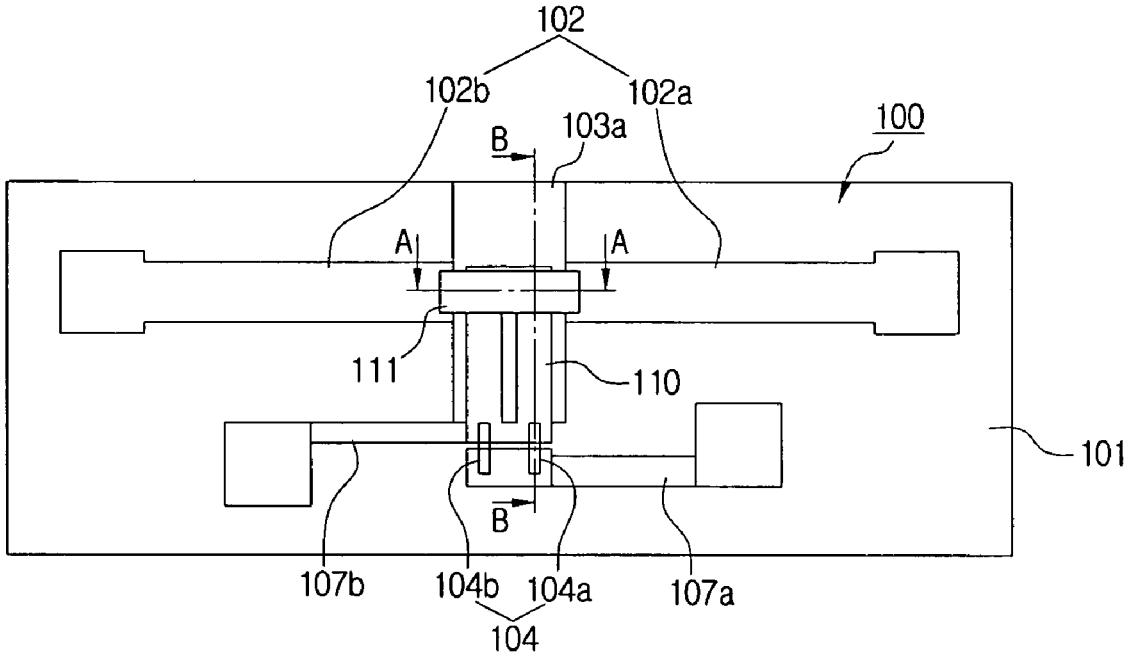
FIG. 4A is a plan view of FIG. 3.
Figure 4B:
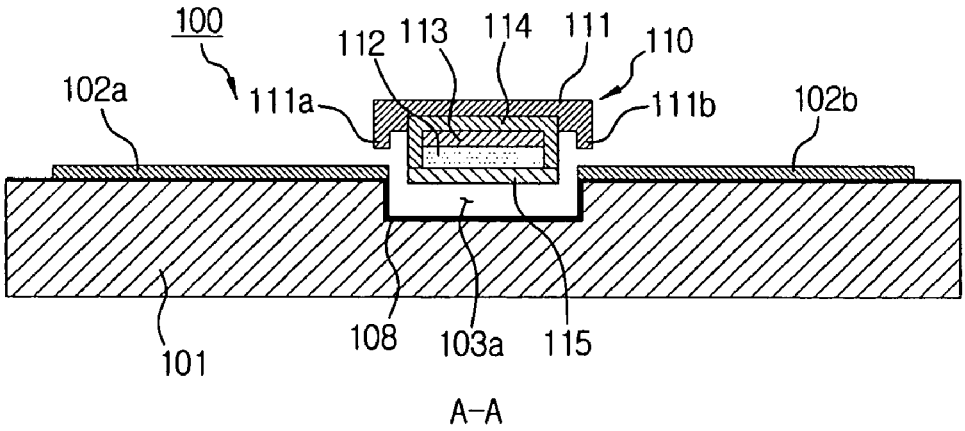
FIG. 4B is a sectional view taken along line A-A of FIG. 4A.
Figure 4C:
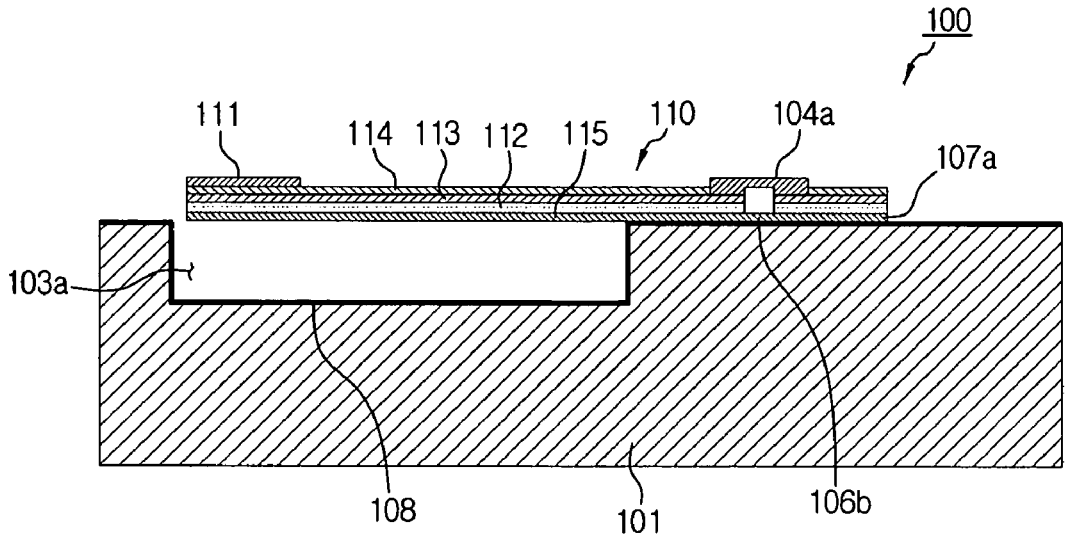
FIG. 4C is a sectional view taken along line B-B of FIG. 4A.

FIG. 3 is a perspective view illustrating a down driven RF MEMS switch according to the first exemplary embodiment of the present invention, FIG. 4A is a plan view of FIG. 3, FIG. 4B is a sectional view taken along line A-A of FIG. 4A, and FIG. 4C is a sectional view taken along line B-B of FIG. 4A.

As shown in FIG. 3 and FIG. 4A to FIG. 4C, the RF MEMS switch 100 according to the first exemplary embodiment of the present invention includes a substrate 101 provided with an RF signal line 102 and a cavity 103*a*, a cantilever 110 positioned on the cavity 103*a*, having one end fixed to the substrate 101, and a contact pad 111 connecting the RF signal line 102 with the cantilever 110 in contact with the RF signal line 102 when the cantilever 110 is down driven.

The substrate 101 may be provided with a CPW line on an upper surface, which includes the RF signal line 102 and DC driving lines 107*a* and 107*b*. A cavity 103*a* is formed in the substrate 101 by an etching process. In an exemplary embodiment, the cavity 103*a* is positioned between the RF input signal line 102*a* and the RF output signal line 102B. However, in RF MEMS switches according to other exemplary embodiments of the present invention (see FIG. 5 to FIG. 7), the RF signal line 102 may be positioned in front of the cavity 103*a*.

The RF signal line 102 may be comprised of the RF input signal line 102*a* and the RF output signal line 102*b*. In an exemplary embodiment, the RF signal line 102 is formed below the contact pad 111. In the RF MEMS switch 100 according to the first exemplary embodiment of the present invention, both ends 111*a* and 111*b* of the contact pad 111 respectively contact the RF input signal line 102*a* and the RF output signal line 102*a* in accordance with down driving of the cantilever 110 to transmit the RF signal to the RF signal line 102.

The cantilever 110 may be comprised of one beam (see FIG. 6) or a pair of beams. In an exemplary embodiment, the cantilever 110 is provided with the lower electrode 115, the piezoelectric layer 112, the upper electrode 113, and the membrane 114 in due order from a down direction.

The upper electrode 113 and the lower electrode 115 are respectively connected with the driving lines 107*a* and 107*b* by upper terminal electrodes 104*a* and 104*b* and lower terminal electrodes 106*a* and 106*b*.

The membrane 114 is formed along the longitudinal direction of the cantilever 110. The membrane 114 covers the upper electrode 113 and the piezoelectric layer 112 but opens the lower electrode 115. The cantilever 110 can be down driven by such a structure of the membrane 114.

In an exemplary embodiment, the contact pad 111 is formed on the upper end of the cantilever 110. In the RF MEMS switches according to the other exemplary embodiments of the present invention (see FIG. 5 to FIG. 7), contact pads 211, 311 and 411 may be projected along a longitudinal direction of cantilevers 210, 310, and 410, respectively.

In the RF MEMS switch 100 of the exemplary embodiment of the present invention, a passivation layer 108 may further be formed on the surface of the cavity 103*a*.

Figure 5:
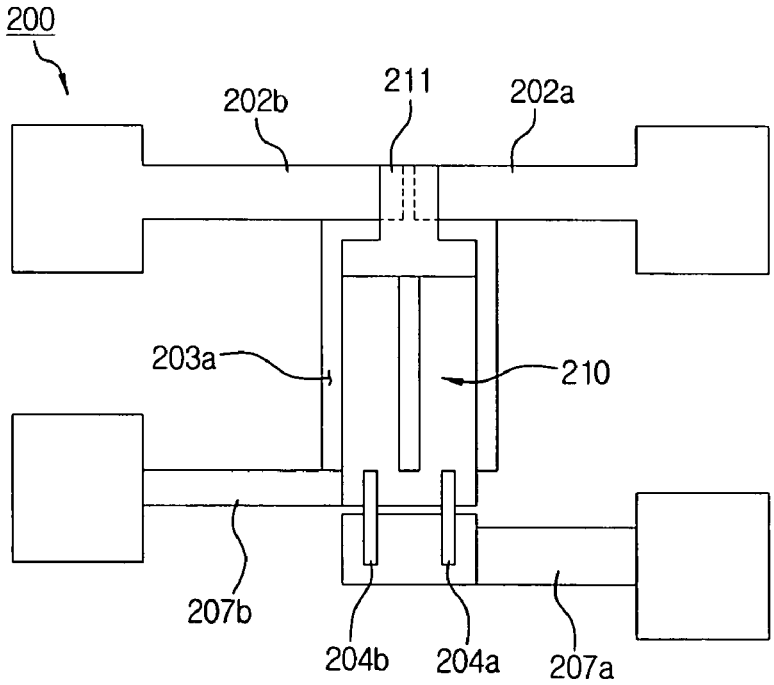
FIG. 5 to FIG. 7 are plan views illustrating RF MEMS switches according to other exemplary embodiments of the present invention.
Figure 6:
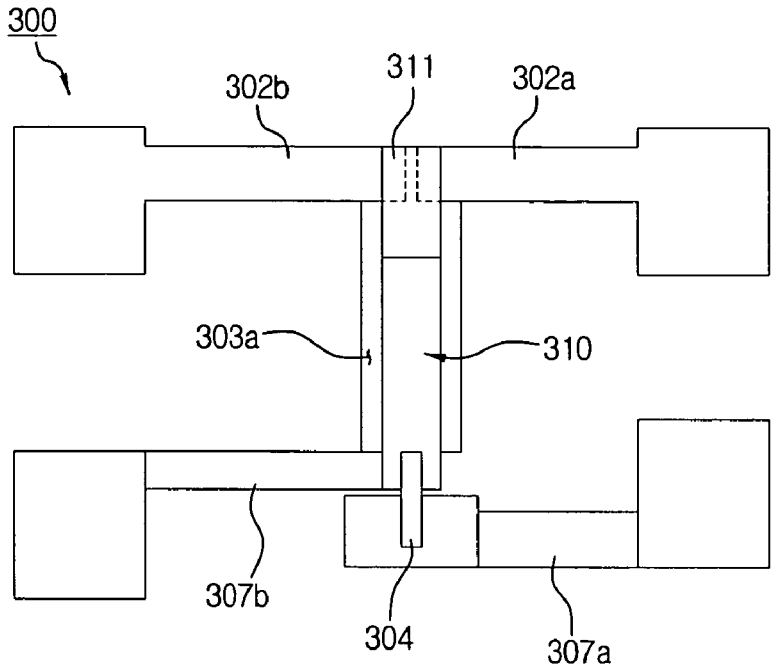
Figure 7:
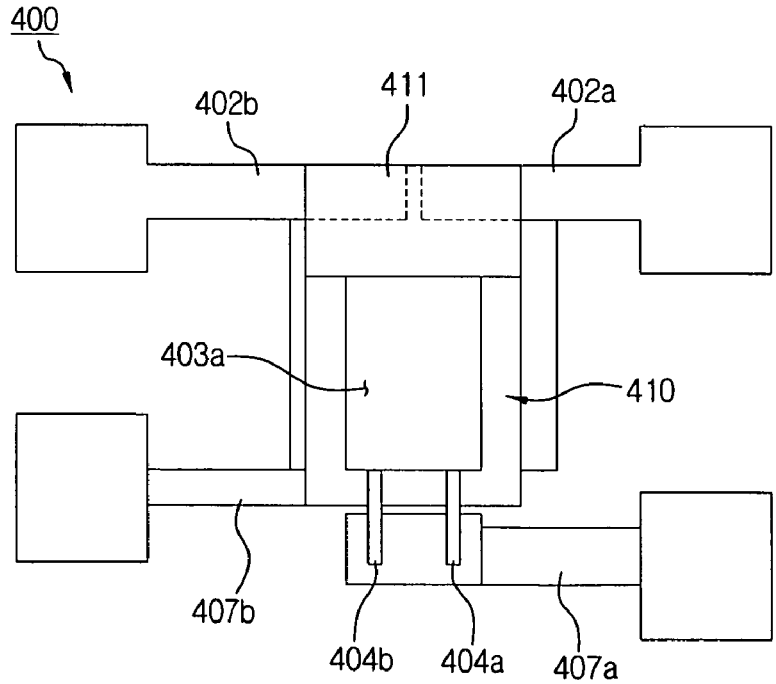

FIG. 5 to FIG. 7 are plan views illustrating RF MEMS switches according to the other exemplary embodiments of the present invention. The RF MEMS switches shown in FIG. 5 to FIG. 7 are different from the RF MEMS switch 100 of the first exemplary embodiment in contact pads or cantilevers. For understanding, since the same reference numbers will be used throughout the drawings to refer to the same or like parts, their repeated description will be omitted.

Unlike the RF MEMS switch 100 according to the first exemplary embodiment of the present invention, the RF MEMS switch 200 according to the second exemplary embodiment of the present invention, shown in FIG. 5, has a structure that the contact pad 211 is more projected than the cavity 203*a*. In the RF MEMS switch 200 constructed as above, since the contact distance between RF signal lines 202*a* and 202*b* and the contact pad 211 is long, the maximum displacement of the cantilever 210 can be used. Therefore, the RF MEMS switch 200 may have excellent isolation property required for RF characteristics.

Unlike the RF MEMS switch 100 according to the first exemplary embodiment of the present invention, the RF MEMS switch 300 shown in FIG. 6 in accordance with the third exemplary embodiment of the present invention is provided with a cantilever 310 having one beam. As a result, the RF MEMS switch 300 according to the third exemplary embodiment of the present invention can readily be fabricated and has a small package area due to a small size.

Unlike the RF MEMS switch 100 according to the first exemplary embodiment of the present invention, the RF MEMS switch 400 shown in FIG. 7 in accordance with the fourth exemplary embodiment of the present invention has a structure that the distance between beams of a cantilever 410 is relatively wide and thus a contact pad 411 has a large size. In the RF MEMS switch 400 as constructed as above, since RF signal lines 402*a* and 402*b* stably contact the contact pad 411, reliability in RF signal transmission would be high.

The operation of the RF MEMS switch 100 according to the first exemplary embodiment of the present invention will be described with reference to the accompanying drawings.

Figure 8:
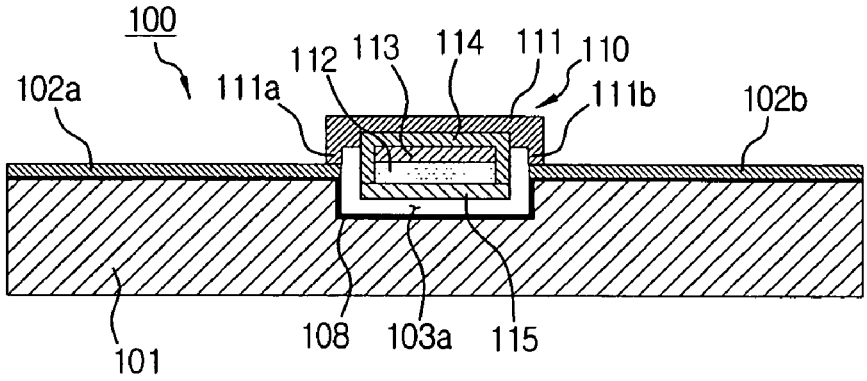
FIG. 8 is a sectional view illustrating the operation of the RF MEMS switch according to the first exemplary embodiment of the present invention.

FIG. 8 illustrates the operation of the RF MEMS switch 100 according to the first exemplary embodiment of the present invention. If the DC voltage is applied to the RF MEMS switch 100 through the driving lines 107*a* and 107*b* (see FIG. 3) as shown in FIG. 4B, the DC voltage is applied to the upper and lower electrodes 113 and 115 through the upper and lower terminal electrodes 104*a*, 104*b*, 106*a*, 106*b*, respectively (see FIG. 3) connected with the driving lines 107*a* and 107*b* (see FIG. 3). At the same time, polarization occurs in the piezoelectric layer 112 of the cantilever 110, and force is applied to the cantilever 110. Since the membrane 114 is positioned on the cantilever 110, the cantilever 110 is down driven in the cavity 103*a* as shown in FIG. 8. In other words, dipole moment occurs in the cantilever 110 as the voltage is applied to the piezoelectric thin film material constituting the membrane 114, whereby the cantilever 110 is down bent. Both ends 111*a* and 111*b* of the contact pad 111 positioned in the cantilever 110 contact the RF signal lines 102*a* and 102*b* formed in the substrate 101 through switching of the cantilever 110, and the RF signal passes through the substrate 101.

Figure 9:
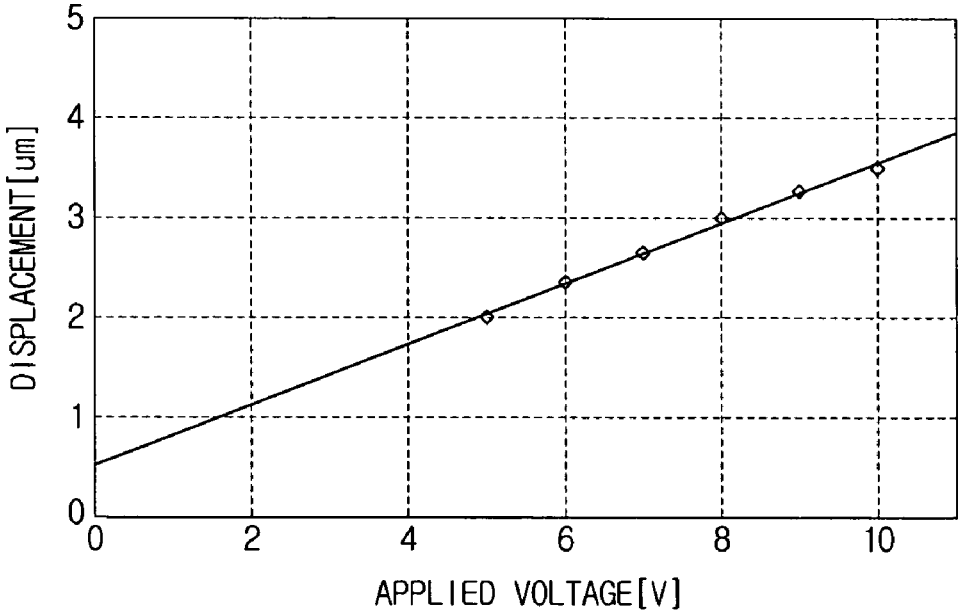
FIG. 9 is a graph illustrating a displacement relation between a voltage applied to the RF MEMS switch of an exemplary embodiment of the present invention and a cantilever.

FIG. 9 is a graph illustrating a displacement relation between the voltage applied to the RF MEMS device 100 and the cantilever 110. As shown in FIG. 9, it is noted that the cantilever 110 is well driven in the RF MEMS device 100 in accordance with the DC voltage. For example, since displacement of 1.5 μm to 2.0 μm is obtained at a voltage of 3V to 5V, the RF MEMS device 100 can stably be operated at a low voltage.

Hereinafter, a method for fabricating the RF MEMS switch according to the exemplary embodiment of the present invention will be described with reference to the accompanying drawings.

FIG. 10A to FIG. 10L are sectional views illustrating a method for fabricating the RF MEMS switch 100 according to the exemplary embodiment of the present invention.

The method for fabricating the piezoelectric RF MEMS device 100 according to the first exemplary embodiment of the present invention is not different from the methods for fabricating the RF MEMS switches according to the second exemplary embodiment to the fourth exemplary embodiment of the present invention in a patterning process. Therefore, a repeated description for the methods for fabricating the RF MEMS switches according to the second exemplary embodiment to the fourth exemplary embodiment will not be described.

Figure 10A:
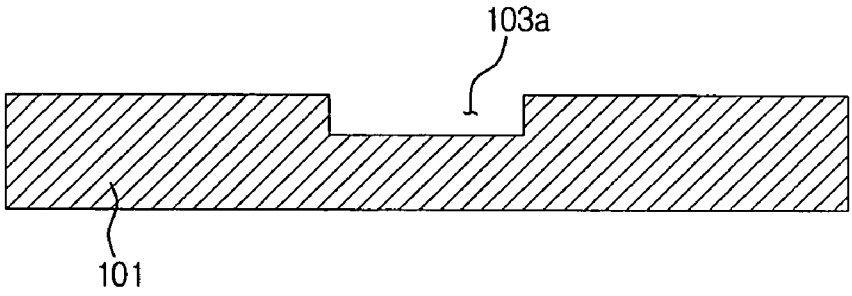
FIG. 10A to FIG. 10L illustrate a method for fabricating an RF MEMS switch according to the first exemplary embodiment of the present invention.

To fabricate the RF MEMS switch 100 according to the first exemplary embodiment of the present invention, the substrate 101 having the cavity 103*a* is prepared (FIG. 10A). The cavity 103*a* of the substrate 101 may be formed by a typical etching process. A silicon wafer such as a high resistance silicon wafer or a high purity silicon wafer, a glass based wafer such as a fused silica, or a quart wafer may be used as the substrate 101.

Then, the cantilever 110 is formed in the substrate 101 provided with the cavity 103*a* (FIG. 10A to FIG. 10F).

Figure 10B:
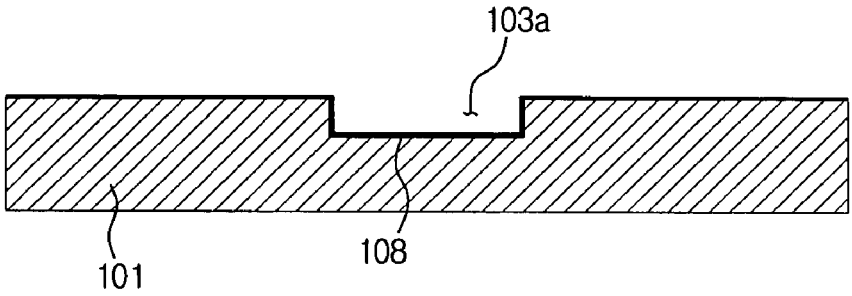

To fabricate the cantilever 110, the passivation layer 108 is formed on the surface of the substrate 101 including the etched cavity 103*a* by a typical deposition process and then patterned (FIG. 10B). Silicon oxide such as $SiO_2$ or silicon nitride such as $Si_3N_4$ may be used as the passivation layer 108.

Figure 10C:
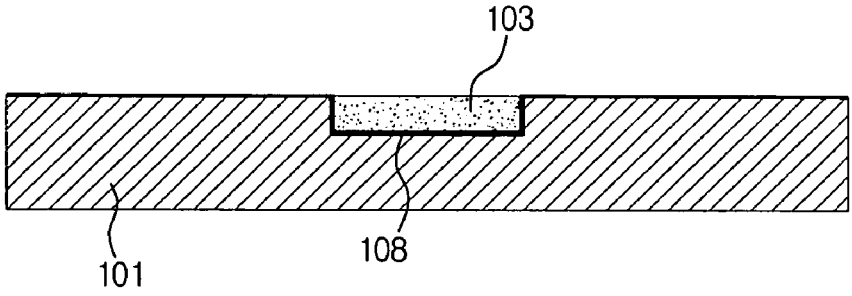

Subsequently, a first sacrificing layer 103 is formed in the cavity 103*a* and then patterned by a chemical mechanical polishing (CMP) process (FIG. 10C). The first sacrificing layer 103 may be formed of polysilicon, LTO, TEOS, polymer for photoresist, metal, or alloy.

Figure 10D:
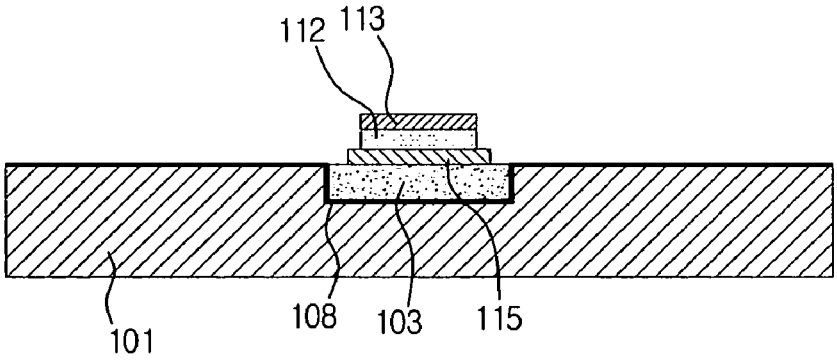
Figure 10E:
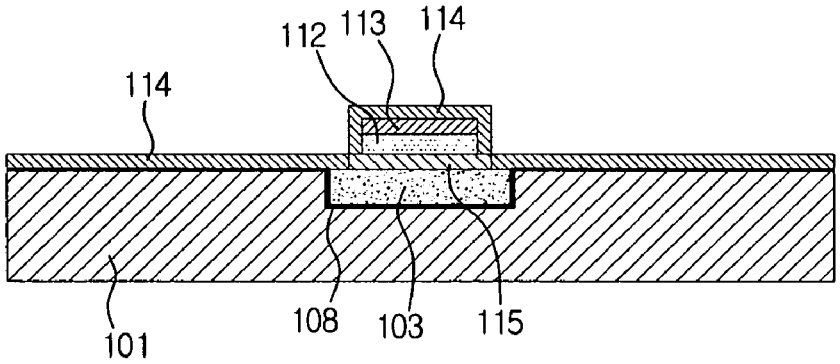
Figure 10F:
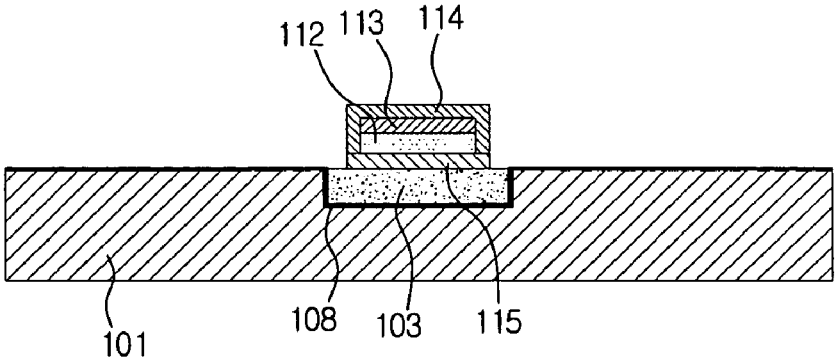

The lower electrode layer 115, the piezoelectric layer 112, the upper electrode layer 113 and the membrane layer 114 are sequentially deposited on the first sacrificing layer 103 and then sequentially patterned (FIG. 10D to FIG. 10F). In this case, the cantilever 110 may be comprised of one or two or more beams in accordance with patterning.

The upper electrode 113 and the lower electrode 115 may be formed of Pt, Rh, Ta, Au, Mo or AuPt. In an exemplary embodiment, the upper electrode 113 and the lower electrode 115 may be formed of Pt. Since Pt has a high melting point, diffusion or silicide does not occur when the piezoelectric layer is sintered if Pt is used as the upper electrode 113 or the lower electrode 115.

The piezoelectric layer 112 may be formed of a piezoelectric material such as PZT, barium titanate, ITO, zinc oxide, and aluminum nitride. In an exemplary embodiment, the piezoelectric layer 112 may be formed of PZT.

The membrane layer 114 may be formed of silicon nitride, aluminum nitride, polysilicon oxide, TEOS, Mo, Ta, Pt, or Rh.

Figure 10G:
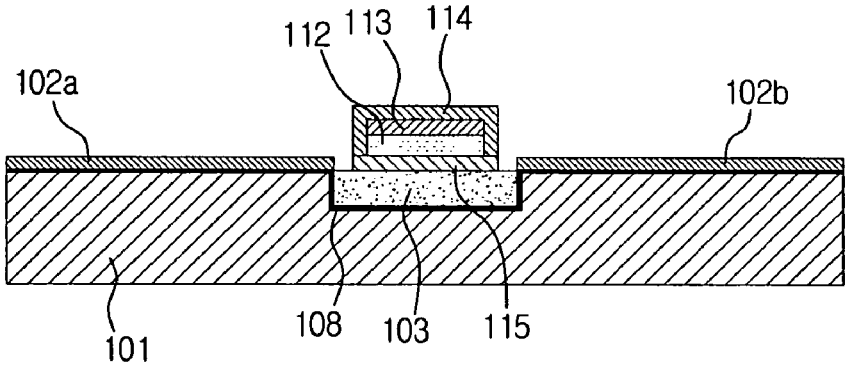

Next, the RF signal lines 102*a* and 102*b* are formed in the substrate 101 provided with the cavity 103*a* (FIG. 10G). The RF signal line 102 is generally formed of Au but may be formed of Rh, Ti, Ta, Pt, or AuNix.

The RF signal line 102 is formed of metal while the piezoelectric material for the cantilever 110 is formed of ceramic. Therefore, the CPW line such as the RF signal line 102 should be formed in the substrate 101 before the cantilever 110 is formed. Since the membrane layer 114 or the piezoelectric layer 112 of a piezoelectric thin film material is fabricated at a high temperature, it is impossible to form the RF signal line below the cantilever 110 in the related art. That is, since the RF MEMS switch that drives the piezoelectric material using a driving mechanism is up driven, the CPW line should be formed above the cantilever.

However, in the exemplary embodiment of the present invention, the CPW line such as the RF signal line 102 or the driving line 107 can be formed to be lower than the cantilever 110. Particularly, since signal lines are formed after the membrane layer 114 is formed, the piezoelectric thin film material can be sintered by the above process order. As a result, it is possible to obtain optimized mechanical displacement of the piezoelectric material. Also, the maximum displacement can be generated by the minimum voltage. Furthermore, in the exemplary embodiment of the present invention, since the cantilever 110 and the RF signal line 102 are formed in one substrate 101, no separate upper substrate is required. Instead, different CPW lines are formed in one substrate in the exemplary embodiment of the present invention. This means that the RF MEMS switch can stably and simply be fabricated.

Figure 10H:
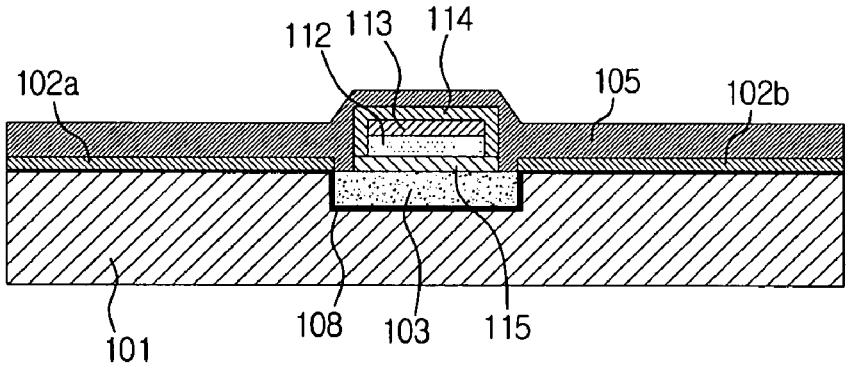
Figure 10I:
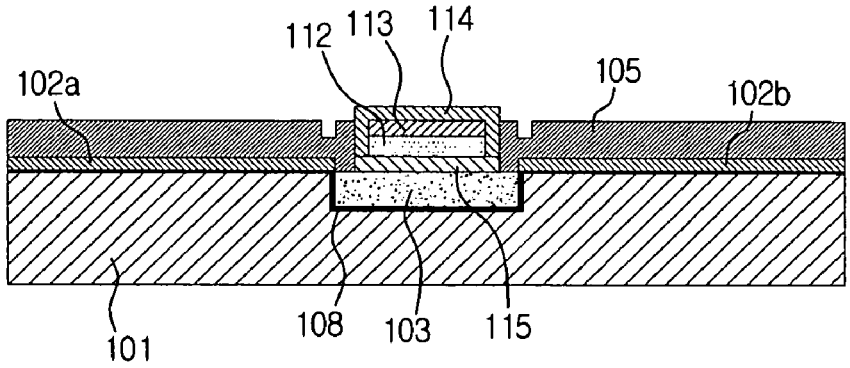
Figure 10J:
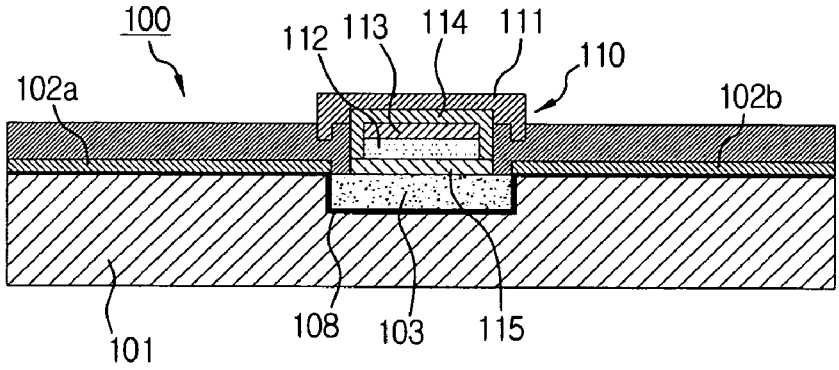

Afterwards, the contact pad 111 is formed on the upper end of the cantilever 110 (FIG. 10H to FIG. 10J).

Figure 10K:
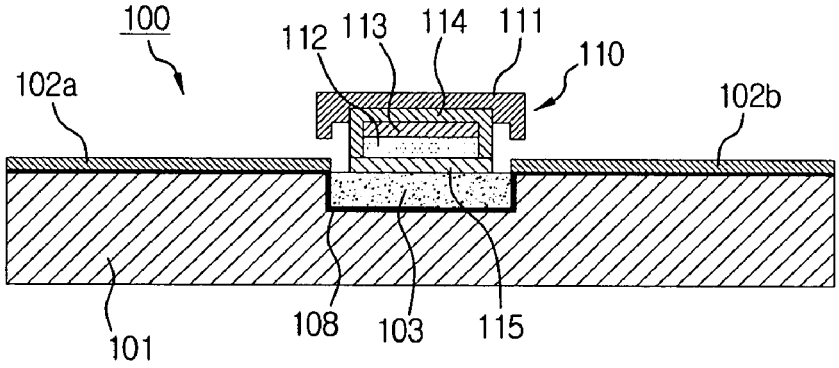
Figure 10L:
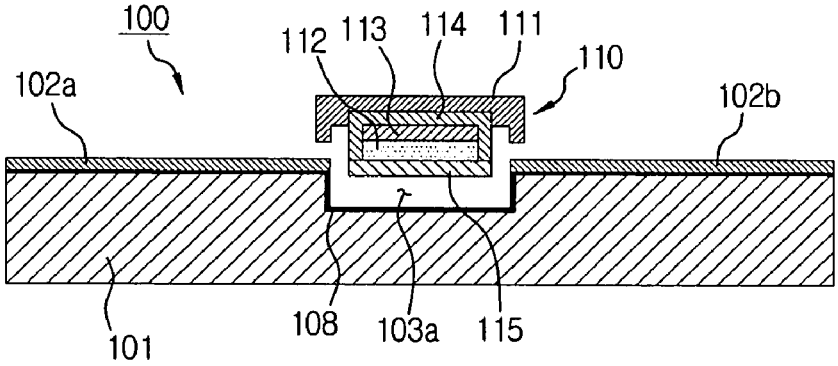

To form the contact pad 111, a second sacrificing layer 105 is deposited on the first substrate 101 provided with the RF signal line 102 (FIG. 10H). In this case, a gap between the RF signal line 102 and the contact pad 111 can be controlled by the thickness of the second sacrificing layer 105. The second sacrificing layer 105 may be formed of polysilicon, LTO, TEOS, polymer for photoresist, metal, or alloy. After the second sacrificing layer 105 is patterned to expose the cantilever 110 (FIG. 10I), the contact pad 111 is formed on the upper end of the cantilever 110 (FIG. 10J). Then, the second sacrificing layer 105 and the first sacrificing layer 103 are sequentially removed from the substrate 101 (FIG. 10K and FIG. 10L). The cantilever 110 of the RF MEMS switch from which the first and second sacrificing layers 103 and 105, respectively, are removed has a floating structure. Therefore, if the DC voltage is applied from the driving lines 107*a* and 107*b* to the cantilever 110, the cantilever 110 is down bent to contact the contact pad 111 with the RF signal line 102 so that the RF signal can be transmitted.

As described above, in the piezoelectric RF MEMS switch of the exemplary embodiment of the present invention, the CPW line and the piezoelectric cantilever can be formed in one substrate, and the CPW line can be formed to be lower than the piezoelectric cantilever. Also, since the RF MEMS switch has a simple structure, it is possible to achieve miniaturization of the part.

Further, the RF MEMS switch of the exemplary embodiment of the present invention can stably be operated at a lower driving voltage without power consumption. Moreover, the RF MEMS switch can stably be fabricated in accordance with the fabricating method according to the exemplary embodiment of the present invention.

The foregoing embodiments are merely exemplary and are not to be construed as limiting the present invention. The present teaching can be readily applied to other types of apparatuses. Also, the description of the exemplary embodiments of the present invention are intended to be illustrative, and not to limit the scope of the claims, and many alternatives, modifications, and variations will be apparent to those skilled in the art.

What is claimed is:

1. A radio frequency microelectromechanical system (RF MEMS) switch comprising:

an undivided substrate comprising RF signal lines and a cavity;

a cantilever positioned on the cavity, having one end fixed to the undivided substrate; and a contact pad formed on an upper end of the cantilever and connecting the RF signal lines when the cantilever is down driven, wherein the cantilever comprises a lower electrode, a piezoelectric layer, an upper electrode, and a membrane in order from the undivided substrate.

2. The RF MEMS switch as claimed in claim 1, wherein the undivided substrate comprises a coplanar waveguide (CPW) line.

3. The RF MEMS switch as claimed in claim 1, wherein the RF signal lines comprises an RF input signal line and an RF output signal line.

4. The RF MEMS switch as claimed in claim 1, wherein the RF signal lines are formed to be in a lower location than the contact pad.

5. The RF MEMS switch as claimed in claim 3, wherein the cavity is positioned between the RF input signal line and the RF output signal line.

6. The RF MEMS switch as claimed in claim 1, wherein the cantilever comprises one beam.

7. The RF MEMS switch as claimed in claim 1, wherein the cantilever comprises a pair of beams.

8. The RF MEMS switch as claimed in claim 1, wherein the upper electrode and the lower electrode are respectively connected with driving lines.

9. The RF MEMS switch as claimed in claim 1, wherein the membrane is formed to open the lower electrode.

10. The RF MEMS switch as claimed in claim 1, wherein the contact pad is projected along a longitudinal direction of the cantilever.

11. The RF MEMS switch as claimed in claim 1, further comprising a passivation layer formed on a surface of the undivided substrate.

12. A method for fabricating a radio frequency microelectromechanical system (RF MEMS) switch comprising:

forming a cavity in an undivided substrate;

fabricating a cantilever on the cavity;

forming RF signal lines in the undivided substrate provided with the cavity; and forming a contact pad on an upper end of the cantilever, wherein fabricating the cantilever comprises:

forming a passivation layer on the undivided substrate;

forming a first sacrificing layer in the cavity; and sequentially forming a lower electrode layer, a piezoelectric layer, an upper electrode layer, and a membrane layer on the first sacrificing layer and patterning the lower electrode layer, the piezoelectric layer, the upper electrode layer, and the membrane layer.

13. The method as claimed in claim 12, wherein forming the cavity comprises an etching process.

14. The method as claimed in claim 12, wherein the passivation layer is formed of silicon oxide or silicon nitride.

15. The method as claimed in claim 12, wherein the first sacrificing layer is formed of any one of polysilicon, low temperature oxide (LTO), Tetraethylorthosilicate (TEOS), polymer for photoresist, metal, and alloy.

16. The method as claimed in claim 12, wherein the upper electrode and the lower electrode are formed of any one of platinum (Pt), rhodium (Rh), tantalum (Ta), gold (Au), molybdenum (Mo) and AuPt.

17. The method as claimed in claim 12, wherein the piezoelectric layer is formed of a piezoelectric material such as lead zirconate titanate (PZT), barium titanate, indium tin oxide (ITO), zinc oxide, and aluminum nitride.

18. The method as claimed in claim 12, wherein the membrane layer is formed of one of silicon nitride, aluminum nitride, polysilicon oxide, Tetraethylorthosilicate (TEOS), molybdenum (Mo), tantalum (Ta), platinum (Pt), and rhodium (Rh).

19. The method as claimed in claim 12, wherein the RF signal lines are formed of one of gold (Au), rhodium (Rh), titanium (Ti), tantalum (Ta), platinum (Pt), and gold/nickel alloy (AuNix).

20. The method as claimed in claim 12, wherein the forming the contact pad comprises:

depositing a second sacrificing layer on the undivided substrate provided with the RF signal lines and patterning the second sacrificing layer;

forming the contact pad on the cantilever on the patterned sacrificing layer; and removing the first and second sacrificing layers.

21. The method as claimed in claim 20, wherein a gap between the RF signal lines and the contact pad is controlled by the thickness of the second sacrificing layer.

22. The method as claimed in claim 20, wherein the second sacrificing layer is formed of one of polysilicon, low temperature oxide (LTO), Tetraethylorthosilicate (TEOS), polymer for photoresist, metal, and alloy.

* * * * *